US005238191A

United States Patent [19]

Gaymon

[11] Patent Number: 5,238,191

[45] Date of Patent: Aug. 24, 1993

[54] CONTROL SYSTEM FOR A FLUID DISPENSER

[75] Inventor: Charles Gaymon, Rockhill, S.C.

[73] Assignee: Textron Inc., Providence, R.I.

[21] Appl. No.: 816,217

[22] Filed: Jan. 3, 1992

[51] Int. Cl.[5] ..... B05B 7/02; B05B 9/01

[52] U.S. Cl. ..... 239/526; 222/63

[58] Field of Search ..... 222/153, 333, 402.11, 222/145, 465.1, 466, 63, 323; 239/525, 526, 310, 318; 227/8, 130; 124/40

[56] References Cited

U.S. PATENT DOCUMENTS

| | | | |
|---|---|---|---|
| 3,335,962 | 8/1967 | Schmidt | 239/332 |
| 3,421,697 | 1/1969 | Marks | 239/152 |
| 3,580,509 | 5/1971 | Goss | 239/526 X |
| 3,690,558 | 9/1972 | Tuttle | 239/127 |
| 3,829,023 | 8/1974 | Bouillard et al. | 239/526 X |
| 3,831,845 | 8/1974 | Pacht | 239/76 |
| 3,834,621 | 9/1974 | Pacht et al. | 239/76 |
| 3,885,739 | 5/1975 | Tuttle | 239/124 |
| 3,977,603 | 8/1976 | Magee, Jr. | 239/76 |
| 4,176,793 | 12/1979 | Heinrich | 239/526 X |
| 4,432,483 | 2/1984 | Kuck | 239/525 X |
| 4,682,710 | 7/1987 | Turner, Jr. et al. | 222/63 |
| 4,834,297 | 5/1989 | Cumming et al. | 239/525 X |
| 4,850,513 | 7/1989 | Porter | 222/1 |
| 4,858,828 | 8/1989 | Stachowiak | 239/76 |
| 4,915,304 | 4/1990 | Campani | 239/526 X |
| 5,040,950 | 8/1991 | Dalquist, III et al. | 417/234 |

*Primary Examiner*—Andres Kashnikow
*Assistant Examiner*—Kenneth DeRosa
*Attorney, Agent, or Firm*—Perman & Green

[57] ABSTRACT

A pressure washer having a motor and a dispensing handle for dispensing a fluid. The handle has a frame and a portion of a control system having two controls connected to the frame. The two controls need to be actuated in order for the pressure washer to operate and, are suitably located on the frame such that a user can actuate both controls with a single hand while holding the frame with the same hand. The controls comprise a part of a pneumatic safety system extending between the handle and motor to prevent unintentional dispensing of fluid from the pressure washer. The control system for the pressure washer can be used to control a throttle on the motor.

20 Claims, 2 Drawing Sheets

CONTROL SYSTEM FOR A FLUID DISPENSER

BACKGROUND OF THE INVENTION

1. Field of the Invention

The present invention relates to fluid dispensers and, more particularly, to a control system for a fluid dispenser such as a pressure washer.

2. Prior Art

U.S. Pat. No. 5,040,950 to Dalquist, III et al. disclose a power washing apparatus with a wand that has a trigger that pinches a tube. U.S. Pat. No. 4,850,513 to Porter discloses a control system for a pump with nozzles having on/off switches and microswitches actuated by handles. Both the switches and microswitches for each nozzle must be actuated for the pump to operate. U.S. Pat. No. 3,690,558 to Tutle discloses a hydraulic cleaning device with a handle assembly. U.S. Pat. No. 3,885,739 to Tuttle discloses a pressure fluid cleaning device with a safety interlock interposed between a valve control and switch control. The safety interlock prevents the switch control from operating unless the valve is closed.

A problem exists with prior art devices in that no suitable system has been provided in a fluid dispensing system having a variable speed motor that can control the speed of the motor from a dispensing handle that is relatively simple and inexpensive to manufacture.

Another problem exists with the prior art in that no adequate safety system was provided in a fluid dispensing system to prevent inadvertent fluid dispensing.

It is therefore an objective of the present invention to provide a new and improved control system for a fluid dispenser.

SUMMARY OF THE INVENTION

The foregoing problems are overcome and other advantages are provided by a new and improved control system for a fluid dispenser.

In accordance with one embodiment of the present invention, a handle for use with a fluid pump for dispensing a fluid is provided. The handle comprises a frame, a first control, a second control, and means for signaling. The frame forms a hand grip section and has a fluid conduit passing therethrough. The first control is mounted to the frame. The second control is also mounted to the frame, and the first and second controls are suitably located relative to each other and the hand grip section such that a user can actuate both controls with a single hand while holding the frame at the hand gripped section with the same hand. The means for signaling can signal an occurrence of both controls being actuated by a user.

In accordance with another embodiment of the present invention, a pneumatic safety system for a fluid dispenser is provided. The dispenser has a motor adapted to pump a fluid, means for controlling pumping of the fluid by the motor, and a dispensing handle connected to the motor by a hose. The safety system comprises a control conduit having a first end connected to the means for controlling pumping of fluid by the motor, and a second end connected to the dispensing handle. The second end of the control conduit has at least one open aperture. The safety system further comprises means at the handle for selectively closing at least one open aperture and, means at the handle for moving a fluid in the conduit and out the conduit first end whereby at least one open aperture must be closed before the means for moving can move fluid out of the conduit first end.

In accordance with another embodiment of the present invention, a pressure washer is provided. The pressure washer has a motor adapted to pump a fluid, a hose connected to the motor, a dispensing wand connected to the hose, and a fluid dispensing control. The fluid dispensing control comprises a first controller, a second controller, and means for signaling the first controller of actuation of two second controller switches. The first controller is connected to the motor. The second controller is connected to the wand and has at least two switches operable by a single hand of a user while grasping the wand with the same hand.

In accordance with another embodiment of the present invention, a pressure washer is provided having a motor adapted to pump a fluid, a hose connected to the motor, a dispensing wand connected to the hose, and a fluid dispensing control. The fluid dispensing control comprises a control conduit having a first end connected to the motor and a second end connected to the dispensing handle; means, at the handle and connected to the conduit second end, for moving fluid in the control conduit; and means, at the motor and connected to the conduit first end, for controlling the speed of the motor such that a user can use the means for moving fluid at the dispensing handle to control the speed of the motor, and, hence, control the dispensing of fluid from the pressure washer.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
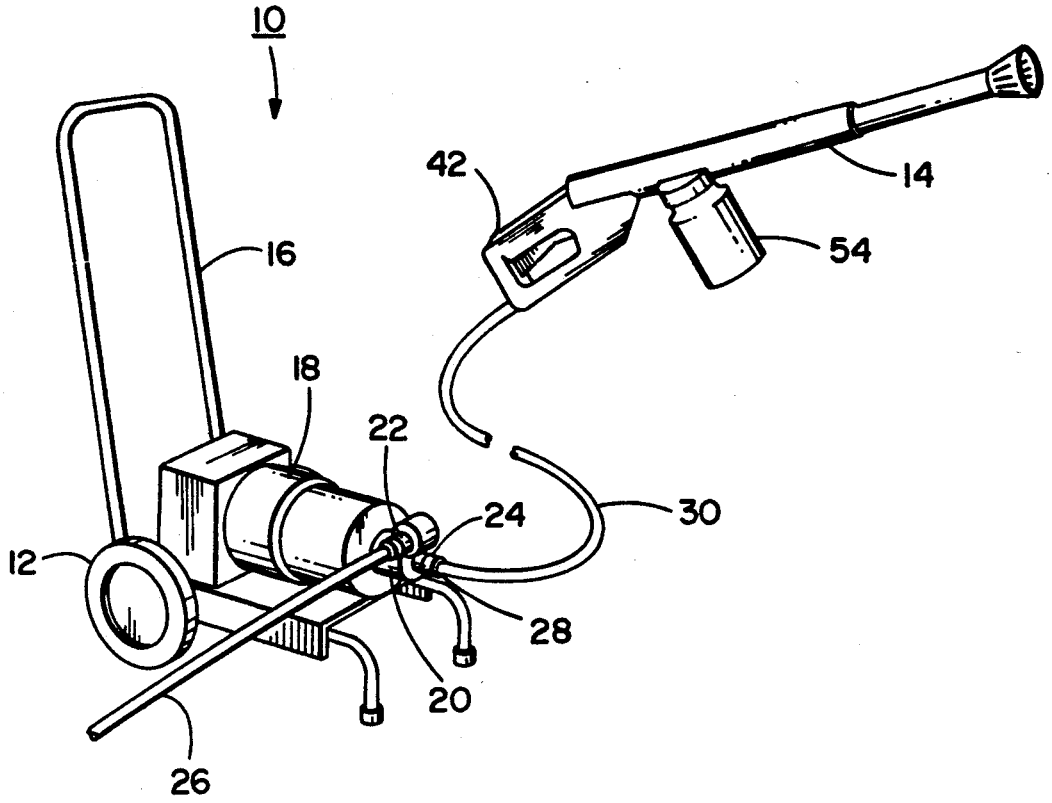
FIG. 1 is a perspective view of a pressure washer system incorporating features of the present invention.

Referring to FIG. 1, there is shown a pressure washer system 10 incorporating features of the present invention. It should be understood that, although the present invention is being described with reference to the embodiment shown in the drawings, the present invention can be used in any suitable type of fluid dispenser. In addition, the present invention can include any suitable size, shape or type of elements or materials without departing from the spirit of the invention as described below.

The system 10, in the embodiment shown, generally comprises a base 12 and a dispensing handle or wand 14. The base 12 includes a frame 16, a motor 18, and a fluid pump 20. The motor 18 may comprise either an electric motor or internal combustion engine. The motor 18 is suitably connected to the pump 20 to drive the pump. The pump 20 includes an inlet 22 and an outlet 24. The inlet 22 is adapted to have the end of a garden hose 26 removably connected thereto to supply water to the pump 20. However, any suitable type of connection or fluid supply to the pump 20 could be provided. The outlet 24 is adapted to have an end 28 of a pressurized fluid conduit or hose 30 removably connected thereto. The hose 30 is adapted to supply pressurized fluid, such as water, from the pump 20 to the dispensing handle 14. In the embodiment shown, the hose 30 travels into and through the frame of the dispensing handle 14. However, in an alternate embodiment, the handle 14 may have a separate pressurized fluid conduit of its own and the hose 30 may have a suitable coupling to removably connect the hose 30 to the handle 14. The base and handle arrangement allows the user increased ease of mobility and use of the system.

Figure 2:
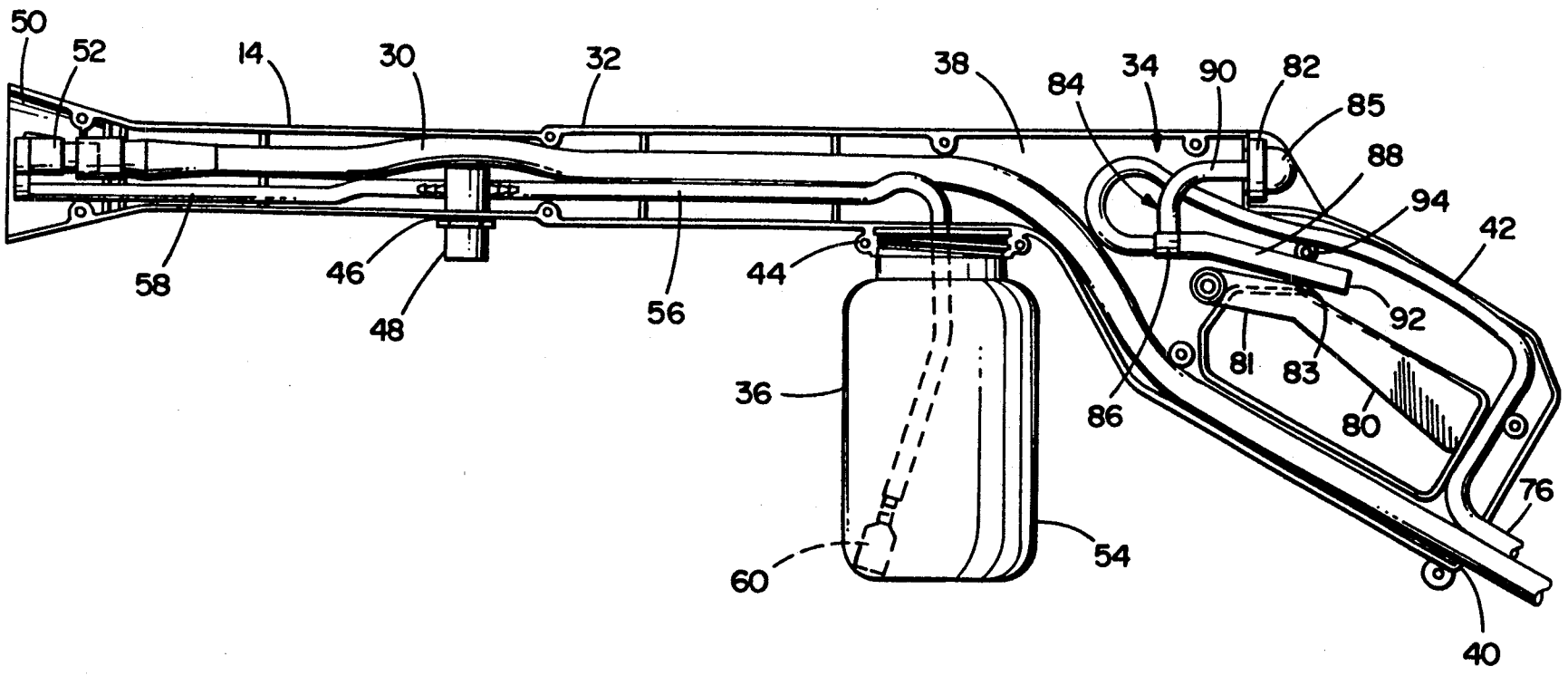
FIG. 2 is a schematic sectional view of the dispensing handle of the system shown in FIG. 1.

Referring also to FIG. 2, there is shown a schematic sectional view of the handle 14 shown in FIG. 1. In the embodiment shown, the handle 14 includes a frame or housing 32, a handle pressurized fluid dispensing control section 34, a second fluid dispensing system 36, and a portion of the hose 30. The frame or housing 32, in the embodiment shown, is comprised of two substantially mirror-like half shell members that are connected to each other to form an interior space 38 inside the housing 32. In a preferred embodiment the shell members are comprised of a plastic or polymer material for light weight.

However, any suitable material or combination of materials can be provided. The housing 32 includes a rear aperture 40, a hand grip section 42, a secondary fluid bottle mount 44, an aperture 46 for mounting a secondary fluid control 48, and a forward dispensing aperture 50. The hose 30 enters the housing 32 at the rear aperture 40, travels the length of the housing, and terminates at a nozzle 52 connected to housing 32 at the forward aperture 50. Thus, pressurized fluid from the pump 20 can travel through the hose 30 and housing 32, and exit the system 10 at the nozzle 52.

The second fluid dispensing system 36 generally comprises a storage bottle 54, a first conduit 56, the control 48, and a second conduit 58. The storage bottle 54 is removably connected to the housing 32 at mount 44 such that it can be refilled. The first conduit 56 has a filter 60 at one end which is located in the bottle 54. The first conduit 56 extends up into the housing 32 and is connected to the control 48. The control 48 in the embodiment shown, is a push button pump. However, any suitable type of control could be provided. The second conduit 58 extends from the control 48 to the nozzle 52 where secondary fluid, such as a cleaning fluid, chemical solvent, or soap, can be mixed with the pressurized fluid as it is propelled from the nozzle 52. However, it should be understood that any suitable type of secondary fluid dispensing system could be provided. In the alternative, no secondary fluid dispensing system need be provided.

Figure 3:
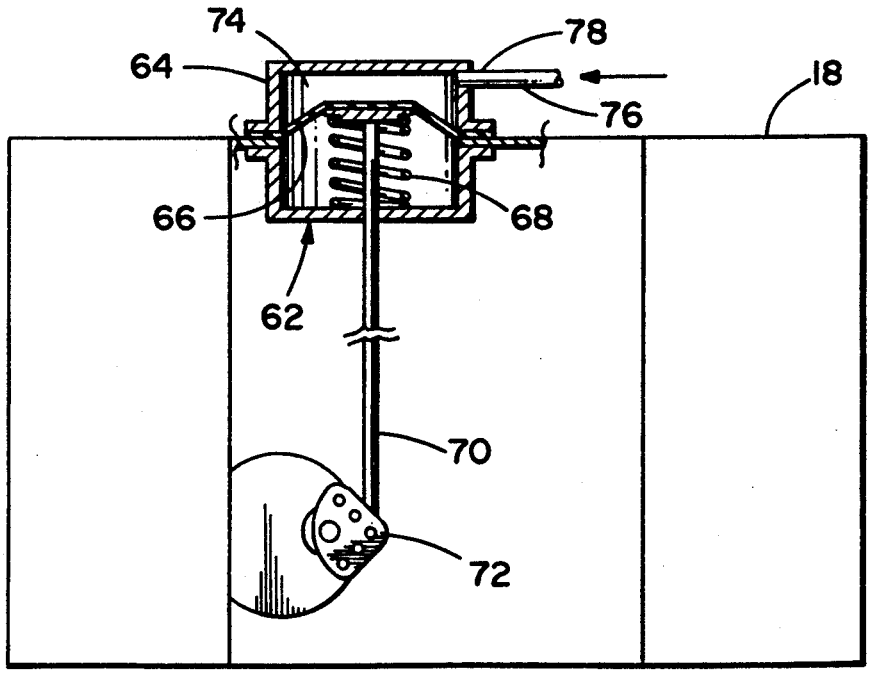
FIG. 3 is a schematic cross-sectional view of a controller connected to the throttle of the motor of the system shown in FIG. 1.

In the embodiment shown, the system 10 includes a safety and control system to control the dispensing of pressurized fluid. The safety and control system includes a first controller connected to the motor, a second controller connected to the handle or wand, and means for signaling the first controller of proper actuation of the second controller. Referring also to FIG. 3, there is shown one embodiment of a first controller 62 connected to the motor 18. In the embodiment shown, the first controller 62 includes a housing 64, a diaphragm 66, a spring 68, and a connector rod 70. The connector rod 70 is connected to the throttle 72 of the motor 18 such that movement of the rod 70 can increase or decrease the speed of the motor 18 and, thus, increase or decrease the speed of the pump 20. The rod 70 is biased by the spring 68 at a home position; preferably a low speed position. The rod 70 can be moved from its low speed position to higher speed positions by pressurizing the chamber 74 formed by the diaphragm 66 and housing 64. Pressurizing the chamber 74 causes the diaphragm to move and thereby move the rod 70 and compress the spring 68. The rod 70, in turn, moves the throttle 72. A control conduit 76 is provided between the handle 14 and motor 18 to pressurize the chamber 74. A first end 78 of the control conduit 76 is connected to the housing 64 at chamber 74. However, it should be understood that any suitable type of first controller can be connected to the motor 18 or pump 20 which can provide speed control and/or an ON/OFF capability.

The control conduit 76 is preferably connected along side the hose 30 between the motor 18 and handle 14 such as by means of an outer sheath (not shown) that covers the hose 30 and control conduit 76. However, any suitable connection can be provided or, no connection need be provided. The control conduit 76 enters the handle housing 32 at rear aperture 40 and terminates at the second controller or control section 34. The second controller 34 generally comprises a conduit system 84, and two controls or switches; a first control 80 and a second control 82. The conduit system 84 has a connector 86, a first tube 88, and a second tube 90. The connector 86 is connected to the second end of the control conduit 76. The second tube 90 extends between the connector 86 and the second control 82. The second control 82, in the embodiment shown is a pressure bulb pump connected to the housing 32 and operably connected to the second tube. The pressure bulb pump includes a rubber or polymer boot 85 that can be depressed by an operator's thumb. When the boot 85 is depressed, air located in the boot 85 is forced out of the boot and into the second tube 90. This causes air to move in the conduit system; either out the end 92 or out into chamber 74 as described below. However, any suitable type of second control could be provided. The first tube 88 is also connected to the connector 86 at a first end, but has a substantially open second end 92 in a home position of the second controller 34 shown in FIG. 2. The first tube 88 is preferably made of a resilient polymer material. The first control 80, in the embodiment shown, generally comprises a lever 81 that is pivotally mounted to the housing 32 at the hand grip section 42. In a preferred embodiment, the first tube 88 biases the lever 81 at its home position shown in FIG. 2. However, additional or alternative means could be provided to bias the lever 81 in a home position. The lever 81 and housing 32 preferably also interact with each other to limit the range of movement of the lever 81. The first tube 88 extends between the lever 81 and a portion 94 of the handle housing 34 such that, when the lever 81 is depressed by a user, the lever 81 and portion 94 cooperate to temporarily pinch off the first tube 88, thereby closing access to the open second end 92 through the first tube. In the embodiment shown in FIG. 2, the lever 81 has a pinch section 83 to increase the efficiency of the lever pinching action. With the open second end 92 closed by the pinching action of the lever 81, the handle end of the safety and control conduit system is closed. A user can then depress or actuate second control 82 which causes air to move in the second tube 90 and control conduit 76 to pressurize the chamber 74 at the first controller 62.

The safety and control system shown is operated by the user at the handle 14. Basically, both the first control 80 and second control 82 must be actuated in order to signal and actuate the first controller 62. In the embodiment shown, the first control 80 must be actuated before the second control 82 is actuated in order to properly signal and actuate the first controller 62. If the second control 82 is actuated before the first control 80 is actuated, air is merely pushed out of the open end 92 and does not effect pressurization of chamber 74 in the first controller 62. Release of either of the first or second controls 80 and 82 results in depressurization of the chamber 74 and thus, return of the first controller to a home position by spring 68.

In an alternate embodiment of the invention, a suitable check valve (not shown) may be provided with the second control 82 such that release of the second control 82 will not depressurize the safety and control system. Such a suitable check valve might be used with a second check valve (not shown) at the second control 82 to allow atmospheric air into the second control 82 other than through tube 90. The second control 82 could then be used to provide multiple pressure pumps of air into the safety and control system. In another alternate embodiment, the functions of the first and second controls 80 and 82 could be reversed.

One of the distinctive features of the present invention is the organizational layout of the controls 80 and 82 on the handle housing 32. The two controls 80 and 82 are suitably located relative to each other and the and grip section 42 of the housing 32 such that a user can actuate both controls with a single hand while holding the housing at the hand grip section with the same hand. The first control 80 can be actuated merely by a user grasping the handle 14 at the hand grip section and, the second control 82 is adapted to be depressed by a thumb of the user's hand at the same time. The pneumatic nature of the safety and control system is relatively simple and inexpensive to manufacture. Although the present invention has been described above as using a pneumatic air conduit system with an opening that can be selectively closed, it should also be understood that the present invention can be used with a liquid and/or closed pneumatic safety and control system.

Another obvious advantage of the present invention is the safety provided to prevent unintentional discharge. In the embodiment shown, the pressure washer system 10 will only operate effectively if both the controls 80 and 82 are actuated in their proper order. In addition, release of the first control 80 automatically returns the system 10 back to a home operation condition, such as low pressure or no pressure. This obviously has many advantages for both commercial and residential applications. In a preferred embodiment, a pulsation dampener is also provided, as in the prior art, to reduce vibration and surges for longer machine life and comfortable operation. As can be noted from the above description, the present invention can be used with any suitable hand held spraying or dispensing device.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A handle for use with a fluid pump for dispensing a fluid, the handle comprising:

a frame forming a hand grip section and having a fluid conduit passing therethrough;

a first control mounted to the frame;

a second control mounted to the frame, the first and second controls being suitably located relative to each other and the hand grip section such that a user can actuate both controls with a single hand while holding the frame at the hand grip section with the same hand; and means for signaling an occurrence of both controls being actuated by a user, the means for signaling including a pneumatic conduit system connected to the first and second controls and, the second control for pumping a fluid in the pneumatic conduit system.

2. A handle as in claim 1 wherein the frame further comprises means or adding a cleansing material to he fluid being dispensed from the frame.

3. A handle as in claim 1 wherein the first control comprises a lever at the hand grip section that can be actuated by the user merely by grasping the handle at the hand grip section.

4. A handle as in claim 1 wherein the second control comprises a button adapted to be depressed by a thumb of the user's hand while holding the frame at the hand grip section with the sam hand.

5. A handle as in claim 1 wherein the pneumatic conduit system includes a first section connected to the first control, a second section connected to the second control, and a third section connected to the first and second sections.

6. A handle as in claim 1 wherein the means for signaling includes the first control being adapted to close a portion of the pneumatic conduit system.

7. A pneumatic safety system for a fluid dispenser, the dispenser having a motor adapted to pump a fluid, means for controlling pumping of fluid by the motor, and a dispensing handle connected to the motor by a hose, the system comprising:

a control conduit having a first end connected to the means for controlling pumping of fluid by the motor, and a second end connected to the dispensing handle, the second end having at least one open aperture;

means at the handle for selectively closing the open aperture; and means at the handle for moving a fluid in the conduit and out the conduit first end whereby the open aperture must be closed before the means for moving can move fluid out of the conduit first end.

8. A system as in claim 7 wherein the means for selectively closing the at least one open aperture comprises means for pinching a portion of the control conduit closed.

9. A system as in claim 8 wherein the means for pinching includes a lever pivotally mounted on the handle.

10. A system as in claim 7 wherein the control conduit second end has a first section

11. A system as in claim 7 wherein the system further comprises a pneumatically actuated controller at the means for controlling pumping that has the control conduit first end connected thereto.

12. A system as in claim 11 wherein the controller is connected to a throttle of the motor to control speed of the motor.

13. A system as in claim 11 wherein the controller includes means to bias the controller at a predetermined setting.

14. A pressure washer having a motor for pumping a fluid, a hose connected to the motor, a dispensing wand connected to the hose, and a fluid dispensing control, the control comprising:

a first controller connected to the motor;

a second controller connected to the wand, the second controller having at least two switches operatable by a single hand of a user while grasping the wand with the same hand, at least one of the switches for pumping a fluid; and means for signaling the first controller of actuation of both of the second controller switches, the means for signaling including a fluid conduit connected to the switch for pumping a fluid.

15. A pressure washer as in claim 14 wherein the means for signaling includes a pneumatic conduit connecting the first controller with the second controller.

16. A pressure washer as in claim 14 wherein the first controller is adapted to control the speed of the motor.

17. A pressure washer as in claim 14 wherein at least one of the switches includes means to bias the at least one switch in a nonactuated position such that the at least one switch must e continuously held in an actuated position by the user in order for the means for signaling to send a continuous signal to he first controller to operate the pressure washer.

18. A pressure washer as in claim 14 wherein the means for signaling comprises means for preventing the switches rom signaling the first controller unless both switches are actuated.

19. A pressure washer as in claim 18 wherein the means for preventing prevents the switches from signaling the first controller unless the switches are actuated in a predetermined order.

20. A pressure washer having a motor adapted to pump a fluid, a hose connected to the motor, a dispensing handle connected to the hose, and a fluid dispensing control, the control comprising:

a control conduit having a first end connected to the motor and a second end connected to the dispensing handle;

means, at the handle and connected to the conduit second end, for moving fluid in the control conduit, the means for moving including a finger actuated pressure bulb pump; and means, at the motor and connected to the conduit first end, for controlling the speed of the motor such that a user can use the means for moving fluid at the dispensing handle to control the speed of the motor and, hence, the dispensing of fluid from the pressure washer.

* * * * *